US005213131A

United States Patent [19]

Gnauert et al.

[11] Patent Number: 5,213,131

[45] Date of Patent: May 25, 1993

[54] VENTED MIXING-TYPE DIVERTER FAUCET

[75] Inventors: Werner Gnauert, Iserlohn; Frank-Thomas Luig, Fröndenberg, both of Fed. Rep. of Germany

[73] Assignee: Friedrich Grohe Aktiengesellschaft, Hemer, Fed. Rep. of Germany

[21] Appl. No.: 952,963

[22] Filed: Sep. 29, 1992

[30] Foreign Application Priority Data

Nov. 2, 1991 [DE] Fed. Rep. of Germany ..... 4136191

[51] Int. Cl.[5] ..... E03C 11/10

[52] U.S. Cl. ..... 137/218; 137/119

[58] Field of Search ..... 137/119, 217, 218

[56] References Cited

U.S. PATENT DOCUMENTS 3,056,418 10/1962 Adams et al. .

*Primary Examiner*—Gerald A. Michalsky

*Attorney, Agent, or Firm*—Herbert Dubno; Andrew Wilford

[57] ABSTRACT

A diverter-type mixing valve has a body formed with a chamber having opposite ends, a mixed-water feed passage opening into the chamber between its ends, a faucet outlet port opening into the chamber at one end thereof, a vent port opening into the chamber at the other end thereof, a diverter port also opening into the chamber at the other end thereof, and a restriction in the chamber between the feed passage and the ports at the other end. Mixed water is supplied under pressure to the feed passage. A diverter valve in the chamber directs flow from the feed passage out the faucet port when pressure between the restriction and the other end is greater than pressure between the restriction and one end and directs flow from the feed passage to the diverter port when pressure between the restriction and one end is greater than pressure between the restriction and the other end. A one-way vent valve in the vent port only permits flow through the vent port into the chamber and a one-way check valve associated with the diverter port only permits flow through the diverter port out of the chamber.

5 Claims, 1 Drawing Sheet

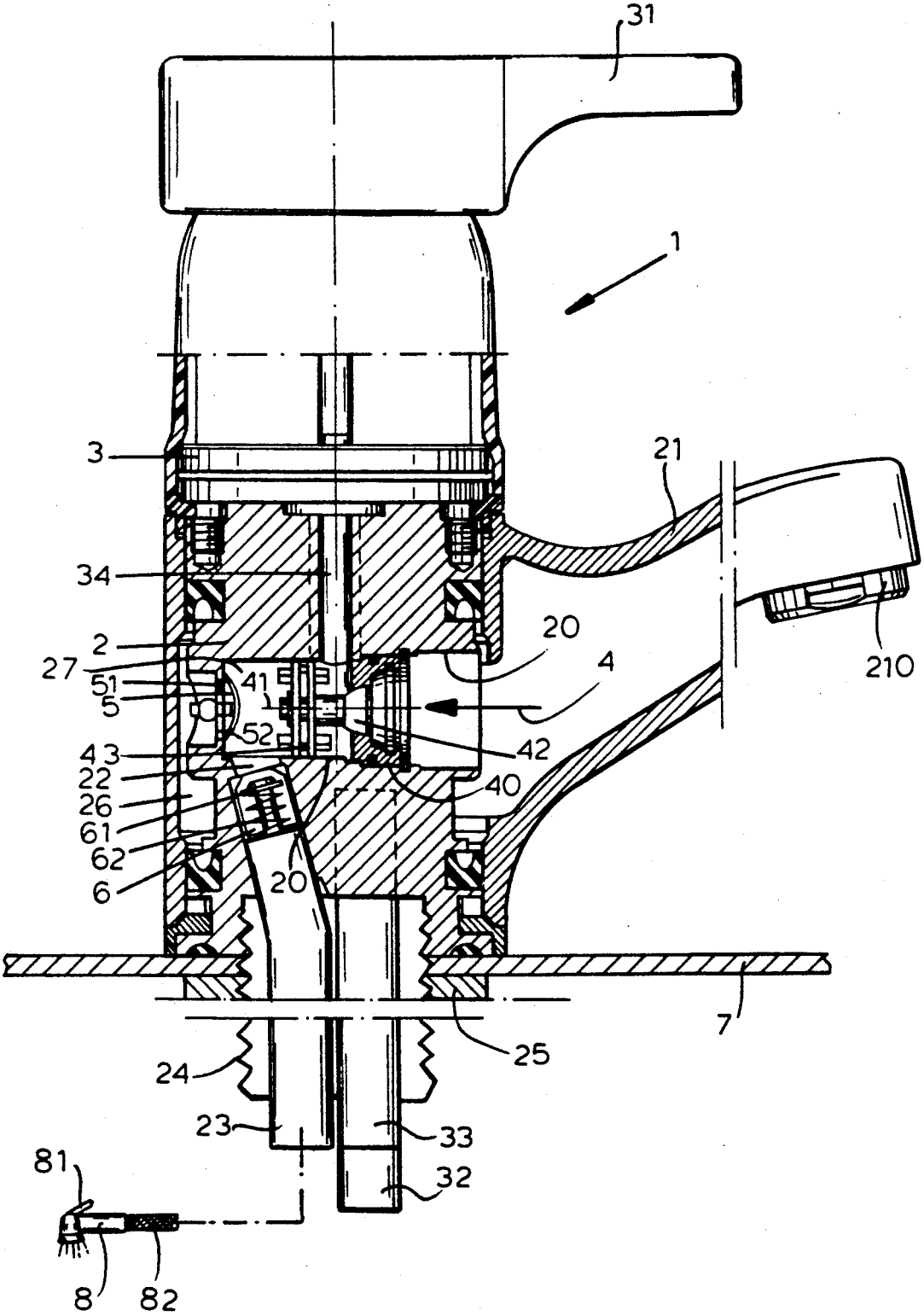
31
1
3
21
34
2
20
27
51
41
4
210
5
52
42
43
22
40
26
61
62
20
6
7
25
24
23
33
81
32
8
82

VENTED MIXING-TYPE DIVERTER FAUCET

FIELD OF THE INVENTION

The present invention relates to a faucet assembly. More particularly this invention concerns a mixing-type faucet assembly with a diverter for a spray or hand shower and equipped with a backflow-preventing vent.

BACKGROUND OF THE INVENTION

A standard diverter-type faucet assembly such as described in U.S. Pat. No. 3,056,418 of Adams has a diverter chamber provided with a diverter valve and connected on one side at a faucet outlet port with the faucet and on the other side via a diverter port to a hose leading to a secondary user, such as for instance a sprayer or a dishwasher. As is standard, when pressure in the hose connected to the diverter port is low when the sprayer or dishwasher valve is open, the diverter valve sends flow to the diverter port instead of to the faucet port.

This arrangement is also provided with an antisiphon or antibackflow vent that opens into the feed passage from which mixed water is fed to the diverter chamber. Thus if pressure in this feed passage drops below atmospheric pressure, the vent opens and the system will suck air rather than sucking water back out of the downstream lines.

Such an arrangement is not only fairly complex, but does not respond in all situations. Water can in fact get from the diverter hose back into the diverter chamber and, in the event of a serious underpressure in the feed passage, can be aspirated into the feed lines.

OBJECTS OF THE INVENTION

It is therefore an object of the present invention to provide an improved vented diverter valve.

Another object is the provision of such an improved vented diverter valve which overcomes the above-given disadvantages, that is which surely and positively prevents backflow under all circumstances.

A further object is to provide such a valve which is fairly simple in construction.

SUMMARY OF THE INVENTION

A diverter-type mixing valve has according to the invention a body formed with a chamber having opposite ends, a mixed-water feed passage opening into the chamber between its ends, a faucet outlet port opening into the chamber at one end thereof, a vent port opening into the chamber at the other end thereof, a diverter port also opening into the chamber at the other end thereof, and a restriction in the chamber between the feed passage and the ports at the other end. Mixed water is supplied under pressure to the feed passage. A diverter valve in the chamber directs flow from the feed passage out the faucet port when pressure between the restriction and the other end is greater than pressure between the restriction and one end and directs flow from the feed passage to the diverter port when pressure between the restriction and one end is greater than pressure between the restriction and the other end. A one-way vent valve in the vent port only permits flow through the vent port into the chamber and a one-way check valve associated with the diverter port only permits flow through the diverter port out of the chamber.

Thus with this system a pressure reversal, that is a subatmospheric pressure, in the feed passage cannot possible suck water back in through the hose or other conduit connected to the diverter port. To start with as soon as the feed pressure starts to draw, it will draw air in through the vent port. In addition the check valve at the diverter port will prevent flow back into it from whatever is hooked up to it.

According to another feature of the invention the diverter valve includes a valve body and a seat at the one end. The restriction is mounted on and movable with the valve body. This construction ensures proper movement of the diverter-valve body.

Furthermore in accordance with this invention a mixing-valve cartridge is fixed on one side of the valve body and conduits extend from the other, normally lower, side of the body and are connected through the valve body to the cartridge and to the diverter port. The body is formed with a throughgoing bore centered on an axis and the diverter valve includes a valve body displaceable axially in the bore.

BRIEF DESCRIPTION OF THE DRAWING

The above and other objects, features, and advantages will become more readily apparent from the following, reference being made to the accompanying drawing whose sole FIGURE is a partly diagrammatic section through a valve assembly according to the invention.

SPECIFIC DESCRIPTION

As seen in the drawing a valve assembly 1 according to this invention has a machined cast body 2 from which a threaded sleeve 24 extends through a counter 7 for securing of this body 2 to the counter 7 by means of a nut 25. Seated atop the body 2 is a standard single-control valve cartridge 3 having a control lever 31. Hot and cold water are supplied via conduits 32 and 33 through unillustrated passages in the body to the cartridge 3 which thus supplies mixed water at a variable temperature and pressure to a central feed passage 34 formed in the body 2. This body 2 is further formed at the lower end of the feed passage 34 with a diametrically throughgoing stepped bore 20 and is surrounded by a faucet 21 having an outlet end 210. Opening at a diverter port 22 into the bottom of the bore 20 offset from the passage 34 is a conduit 23 that leads off via a hose 82 to a sprayer 8 having an on/off valve controlled by a lever 81.

The bore 20 forms a chamber 27 and is provided at one end with a diverter valve 4 and at its opposite end adjacent the port 22 with a vent valve 5. The diverter valve 4 itself comprises a valve seat 40 fixed in the bore 20 and a valve element 42 movable along an axis 41 of the bore 20 between the illustrated position sitting in the seat 40 and an outer position somewhat to the right thereof and permitting flow past the seat 40. As is standard for such a diverter valve 4 the element 42 also carries a restriction body 43 that sits in the bore 20 between the feed passage 34 and the diverter port 22 and vent valve 5.

The vent valve 5 itself has a membrane- or mushroom-type valve body 52 that normally engages over and blocks vent holes 51 that open into an annular chamber 26 surrounding the body 2, feeding the faucet 21, and capable of receiving flow from both ends of the bore 20. This valve 5 therefore only permits flow through the ports 51 into the chamber 27.

A check valve 6 comprised of a valve body 61 biased by a spring 62 is provided in the upstream end of the diverter conduit 23 at the port 22 and is directed to prevent flow backward along the conduit 23 into the bore 20.

The system described above operates as follows:

Under normal circumstances when the valve 81 is closed pressure from the line 34 will enter the chamber 27 defined in the bore 20 between the valves 4 and 5, will flow past the restriction 43 will initially equalize on both sides of this restriction 43 because the valve 5 will close and the closed valve 81 will prevent flow out the port 22. This will cause the valve 4 to open for flow out the faucet 21.

If, however, the valve 81 is open, pressure will be less downstream or to the left as seen in the drawing of the restriction 43 so that the valve 4 will stay closed and flow will be out of the chamber 27 past the valve 5 and through the conduit 23.

Should there be a total failure of pressure in the feed passage 34 all that will happen is that water in the chamber 27 will be sucked back into this passage 34, but since the valve 5 will open after this tiny amount of perfectly clean water is aspirated the passage 34 will only be able to suck air through the ports 51. Flow back up into the chamber 27 through the conduit 23 is blocked by the valve 6.

We claim:

1. A diverter-type mixing valve comprising:

a body formed with a chamber having opposite ends, a mixed-water feed passage opening into the chamber between its ends, a faucet outlet port opening into the chamber at one end thereof, a vent port opening into the chamber at the other end thereof, a diverter port opening into the chamber at the other end thereof, and a restriction in the chamber between the feed passage and the ports at the other end;

means on the body for supplying mixed water under pressure to the feed passage;

means including a diverter valve in the chamber for directing flow from the feed passage out the faucet port when pressure between the restriction and the other end is greater than pressure between the restriction and one end and for directing flow from the feed passage to the diverter port when pressure between the restriction and one end is greater than pressure between the restriction and the other end;

a one-way vent valve in the vent port only permitting flow through the vent port into the chamber; and a one-way check valve associated with the diverter port and only permitting flow through the diverter port out of the chamber.

2. The diverter-type mixing valve defined in claim 1 wherein the diverter valve includes a valve body and a seat at the one end, the restriction being mounted on and movable with the valve body.

3. The diverter-type mixing valve defined in claim 1 wherein the means for supplying includes a mixing-valve cartridge fixed on the valve body.

4. The diverter-type mixing valve defined in claim 3 wherein the valve body has an upper side to which the cartridge is fixed and a lower side from which extend conduits connected through the valve body to the cartridge and to the diverter port.

5. The diverter-type mixing valve defined in claim 1 wherein the body is formed with a throughgoing bore centered on an axis and the diverter valve includes a valve body displaceable axially in the bore.

* * * * *